United States Patent [19]

Perovich

[11] Patent Number: 4,610,389

[45] Date of Patent: Sep. 9, 1986

[54] METHOD FOR TREATING A SINGLE SIDE OF A METALLIC SHEET

[75] Inventor: Paul C. Perovich, Trenton, Mich.

[73] Assignee: Comet Research, Inc., Trenton, Mich.

[21] Appl. No.: 704,743

[22] Filed: Feb. 25, 1985

[51] Int. Cl.[4] ..... B23K 1/20

[52] U.S. Cl. ..... 228/176; 228/191; 29/460

[58] Field of Search ..... 228/191, 18, 176; 427/433, 434.2, 436; 29/460; 204/28

[56] References Cited

U.S. PATENT DOCUMENTS 2,991,550 7/1961 Block ..... 427/434.2 X
3,697,399 10/1972 Usui ..... 204/28 X
4,461,419 7/1984 Mitka et al. ..... 228/191 X

FOREIGN PATENT DOCUMENTS 53-119226 10/1978 Japan ..... 204/28

*Primary Examiner*—Kuang Y. Lin
*Attorney, Agent, or Firm*—Hauke and Patalidis

[57] ABSTRACT

A method for treating a single side surface of a metallic strip, such as a steel strip, by soldering a pair of metallic strips back-to-back along their corresponding edges, preferably inserting a metallic edge insert strips between the two metallic strips at their joined edges. After appropriate treatment of the exposed surfaces of the sandwiched strips, such as dipping in a molten metallic bath, the metallic strips are separated by heating above the melting point of the solder, and peeling the metallic strips away from each other.

40 Claims, 7 Drawing Figures

METHOD FOR TREATING A SINGLE SIDE OF A METALLIC SHEET

CROSS-REFERENCE TO RELATED APPLICATION

This application is related to co-application Ser. No. 704,783, now U.S. Pat. No. 4,582,573, issued Apr. 15, 1986, filed contemporaneously herewith and assigned to the same assignee as the present application.

BACKGROUND OF THE INVENTION

The present invention relates to a method for treating a single side surface of a metallic sheet, such as a steel sheet, for example, leaving the surface of the other side of the sheet untreated.

There is a demand for supplying sheet steel, for example, with a single side surface having been subjected to an appropriate treatment such as applying to a single side surface a coating of zinc or zinc alloy, or a coating of tin, lead, or other dissimilar metal or alloy. For example, sheet steel galvanized on one surface only presents many advantages in the automobile and appliance industries where it is desired to paint the non-treated surface and leave the treated surface intact to resist corrosion, as it is difficult to obtain a good and smooth painted surface over an anti-corrosion coating of zinc or zinc alloy, for example.

Diverse methods have been proposed in the past for, for example, galvanizing only one surface of a steel sheet such as by welding two steel strips back-to-back at their edge, or by crimping the edges, so as to form a sandwich or laminate which is subjected to an appropriate treatment, such as zinc or zinc alloy hot dipping or electrolytic plating. The edge weld or crimping prevents the molten metal or metal alloy, or the electrolyte, from penetrating between the two sandwiched or laminated strips, with the result that only one surface, the exterior surface of each strip, is plated. After treatment, the two strips are separated, generally by shearing off the edges of the sandwiched or laminated strips.

The inconveniences of welding two steel strips back-toback at their edges are that the heat of welding has a pronounced effect on the metallurgy of the steel, and there is a considerable loss of material resulting from the edge shearing. Another inconvenience resulting from forming a sandwich or laminate of two metallic strips by edge crimping is that the crimp may not provide an effective dam preventing molten metal, or electrolyte, from seeping through the crimp and may cause irregular and random seepage through the edge crimp, thus coating or plating a portion of the surfaces which it is desired to protect from treatment.

SUMMARY OF THE INVENTION

The present invention remedies the inconveniences of the prior art by providing a method enabling to momentarily unite back to back two strips of sheet steel, or other metallic strips, and forming an effective dam preventing the molten metal or metal alloy during hot dipping plating, or the electrolyte during electrolytic plating, from penetrating between the sandwiched or laminated strips. The method of the invention has applications more particularly to plating by molten metal or metal alloy dipping, such as galvanizing, as well as to electrolytic or chemical treatment of the exposed surfaces of the sandwiched or laminated strips.

The diverse objects and advantages of the present invention will become apparent to those skilled in the art when the following description of examples of the best modes contemplated at the present for practicing the invention is read in conjunction with the accompanying drawing wherein:

DETAILED DESCRIPTION OF THE PREFERRED EMBODIMENTS

Figure 1:
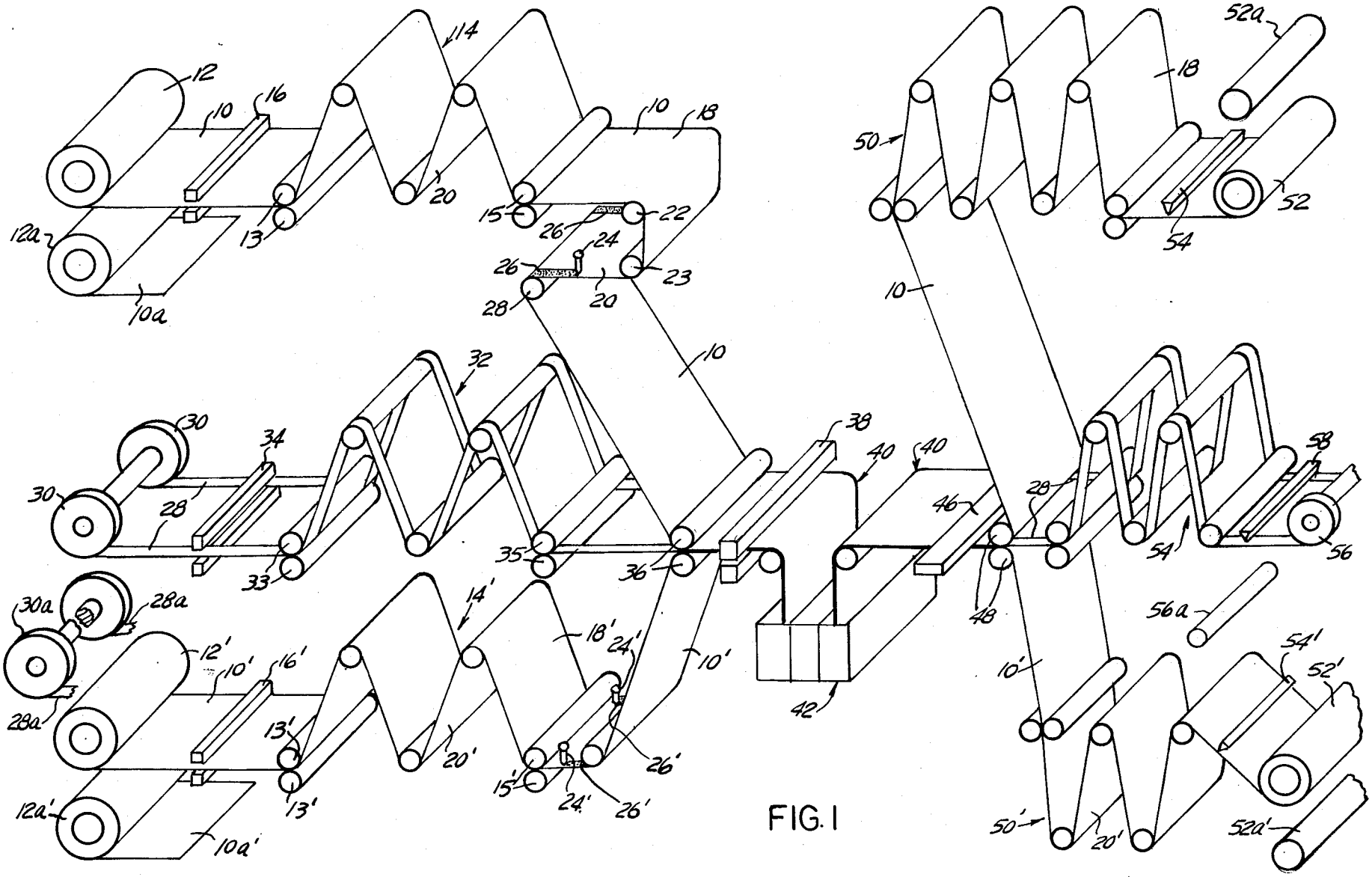
FIG. 1 is a schematic representation of a continuous line steel strip treatment operation according to the present invention.
Figure 2:
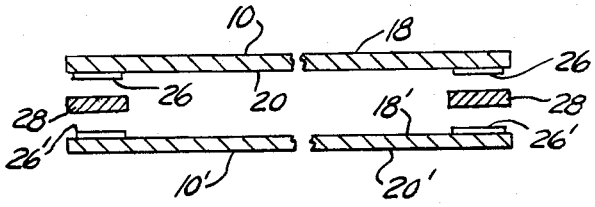
FIGS. 2–4 are transverse sections through the steel strips at appropriate stages of the operation which are useful in explaining the principles of the invention.

Referring to FIG. 1 of the drawing, there is illustrated schematically, and for illustrative purpose only, a continuous steel strip treatment line according to the present invention. A first strip 10 of steel is uncoiled from a coil roll 12 by drive pinch rollers 13 and passed through an accumulator 14. A strip butt-welder 16 is provided between the coil roll 12 and the drive rollers 13 such as to make the process continuous by butt-welding the trailing edge of the strip 10 with the leading edge of a strip **10*a* uncoiled from a coil roll 12*a* when the coil roll 12 is exhausted. The accumulator 14 enables the process to be continuous in spite of uncoiling speed variations, and during stoppages while changing coil rolls and effecting the butt-welding operation of the leading edge of a new strip 10*a* with the trailing edge of the strip 10, strip material from the accumulator 14 being continuously fed forward at a substantially constant speed by an appropriate feeding means such as drive pinch rollers 15**.

A second strip 10' of steel, for example, is uncoiled from a coil roll 12' and fed by drive rollers 13' to an accumulator 14', and by drive pinch rollers 15' from the accumulator 14'. A butt-welder 16' is disposed between the coil roll 12' and the accumulator 14', such that the feeding of the strip 10' is continuous, a strip **10*a*' being obtained from a coil 12*a*' and welded at its leading edge to the trailing edge of the strip 10' when the coil 12'** is exhausted.

The arrangement illustrated at FIG. 1 permits, for example, to plate the upper surface 18 of the strip 10 and to protect from plating the lower surface 20 of the strip 10, and to plate the lower surface 20' of the strip 10', while protecting the upper surface 18' of the strip 10. The strip 10, when exiting from the accumulator 14 is reversed by, for example, being caused to pass over a pair of rollers or drums 22 and 23, such that the strip lower surface 20 is now disposed on the top while passing by a pair of edge solder applying-nozzles 24, each placing at, or proximate to, an edge of the strip lower surface 20 a narrow strip or ribbon 26 of molten solder. Reversing the strip 10 is advantageous so that the edge ribbons 26 of molten solder remain on the surface 20, at the edge of the strip 10, simply by gravity. The distance between the location of the solder nozzles 26 and the roller or drum 28 is such as to allow the solder ribbons 26 to cool sufficiently to solidify.

Similarly, at the outlet of the accumulator 14' the steel strip 10' is directed by a pair of drive pinch rollers 15' under a pair of molten solder-applying nozzles 24' applying on the upper surface 18' of the strip 10' a pair of parallel edge solder strips or ribbons 26', the distance between the location of the solder nozzles 24' and the roller or drum 28 being much longer as schematically shown in the drawing such as to permit the solder ribbons 26' to cool and solidify.

Figure 3:
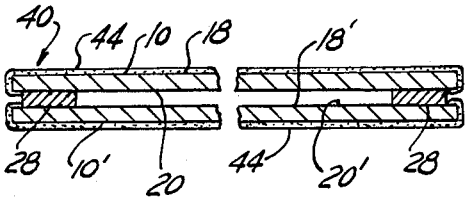

A pair of narrow spaced-apart insert strips 28, made of steel or other appropriate metal pre-coated with a solder of the same composition as the edge solder ribbons 26 and 26', is obtained from a double coil roll 30 and fed through an accumulator 32 by a pair of drive pinch rollers 33. Also, and for the purpose of making the process of the invention a continuous one, a strip butt-welder 34 is provided upstream of the accumulator 32, such that when the twin coil rolls 30 of insert strips 28 are exhausted, the trailing edge of the insert strips 28 may be welded to the leading edge of insert strips **28*a* obtained from a spare twin roll coils 30*a*. At the outlet of the accumulator 32, the two insert strips 28 are fed from a pair of pinch rollers 35 to between the steel strips 10 and 10', each insert strip 28 being located along an edge of, respectively, the lower surface 20 of the strip 10 and the upper surface 18' of the strip 10', a pair of drive pinch rollers 36 applying appropriate pressure such that through passage through a heating chamber 38 the edge solder ribbons 26 of the strip 10 and the edge solder ribbons 26' of the strip 10', and the solder coating the insert strips 28, are heated to their melting temperature. Upon cooling and solidification of the solder, the strips 10 and 10' are joined back-to-back at their edges with the insert strips 28 appropriately soldered therebetween, FIG. 3 illustrating the relative disposition of the strips 10 and 10' and insert strips 28, prior to joining the strips 10 and 10'. The sandwich strip 40, thus formed, is then subjected to appropriate treatments by dipping through chemical cleaning baths, rinsing baths, and the like, and is hot dipped in a molten bath of zinc or zinc alloy, for example, in the treatment section 42 of the line. After emerging from the treatment section 42 of the line, the sandwich strip 40 is provided on its outer surfaces with a plating 44 of zinc or zinc alloy, for example, FIG. 3. The plating 44 is thus placed only on the surface 18 of the strip 10 and on the surface 20' of the strip 10', the surface 20 of the strip 10 and the surface 18' of the strip 10' having been insulated against penetration of the molten metal or metal alloy of the bath by the edge dams provided by the insert strips 28 soldered at the edge of respectively the surface 20 of the strip 10 and the surface 18' of the strip 10'**.

Figure 4:
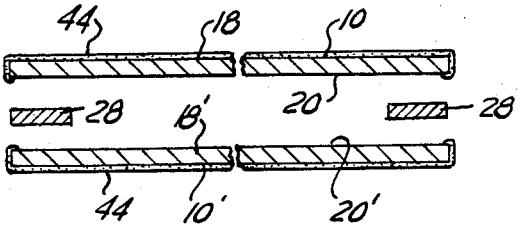

Referring back to FIG. 1, after emerging from the treatment section 42 of the line, the sandwich strip 40 is passed through a heating chamber 46 which heats the sandwich strip 40 to a temperature melting the solder such that the strips 10 and 10' can be peeled away from each other and away from the insert strips 28, as shown at FIG. 4, when emerging from between a pair of drive pinch rollers 48, FIG. 1. The strip 10, plated on its face 18, after passage through an accumulator 50 is wound as a coil 52, while the strip 10', plated on its surface 20', after passage through an accumulator 50' is wound as a coil 52'. Appropriate shears 54 and 54' are provided for cutting off the strips 10 and 10', respectively, when the coils 52 and 52' are full, such as to permit the removal of the coils 52 and 52' and starting the winding of new coils on coil drums **52*a* and 52*a'*. Similarly, the edge insert strips 28, after passage through an accumulator 54 are wound around twin drums 56 or 56*a*, a cut-off shear 58 being provided to cut off the edge insert strips 28 when a twin drum 56** is full.

For some operations, the edge insert strips 28 may be dispensed with, and the strips 10 and 10' fused at their edges after passage through the heat chamber 38 for heating the edge solder ribbons 26 and 26' to their melting temperature, and allowing to cool to solidify the solder.

The following table indicates examples of plating bath compositions, the temperature at which each bath is maintained for plating by hot dipping, and the corresponding composition of the solder ribbons applied to the edges of the strips and of the solder plating the insert strips 28:

| Molten Metal Bath | Melting Temp. C. | Solder Metal | Melting Temp C. |
|---|---|---|---|
| 50% Zn/50% Al | 560 | 40% Zn—60% Al | 580 |
| Zn | 419 | 80% Zn—20% Al | 475 |
| Pb | 326 | Zn | 419 |
| Sn | 232 | 80% Pb—20% Sn | 276 |

It will be appreciated that there is at least a 20° C. difference between the melting point of the solder and the melting point of the hot plating bath. When the sandwich strip 40, FIG. 1, emerges from the molten metal or metal alloy bath, it is substantially at the temperature of the bath, and very little heat is required to be supplied by the heating chamber 46 for unsoldering the strips 10 and 10' and the insert strips 28. The soldering and unsoldering steps may be effected under inert atmosphere to avoid oxidation of the molten solder surface.

Figure 5:
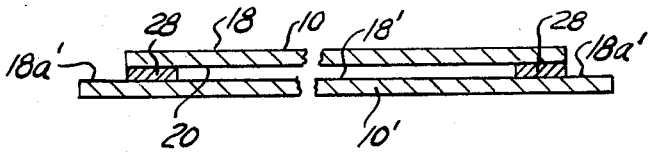
FIGS. 5–7 are views similar to FIG. 3 and relating to a modification of the invention.
Figure 6:
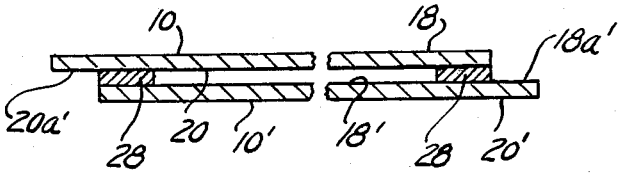
Figure 7:
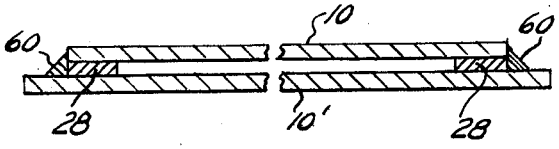

The strips 10 and 10' need not be of the same width. As illustrated at FIG. 5, the strip 10 is narrower than the strip 10' which results in the strip 10' being plated not only on its surface 20' but also around its edges and at portions of its surface 18', as shown at **18*a'*, between each edge and the location of an insert strip 28. Such a result may be advantageous where it is desired to plate the edge of a steel sheet and a narrow marginal area on the unplated face of the sheet, to prevent edge corrosion. Such a controlled plating of the unplated face may be accomplished by using strips 10 and 10' of the same width, and staggering their edges, as shown at FIG. 6, such that marginal areas 18*a'* and 20*a'* are also plated, in addition to surface 18 and 20' of respectively strips 10 and 10'. An additional ribbon of solder may be applied, as shown at 60 at FIG. 7, to further reinforce the dam provided by the edge insert strips 28, in arrangements similar to that of FIG. 5 wherein the strip 10 is narrower than the strip 10', such as to prevent plating of the edge surfaces of the strip 10. Such additional ribbons 60 of solder are conveniently applied at some station of the line of FIG. 1 beyond the soldering heating chamber 38 and prior to introducing the sandwich strip 40 to the treatment section 42**.

It will be appreciated that although the method of the invention has been described, for illustrative purpose, in conjunction with a hot dip process, such as galvanization of sheet steel strips, it may be used for any other treatment where it is desired to treat only a surface of a metallic strip, such as electrolytic galvanizing, electrolytic plating, and chemical treatments.

Having thus described the present invention by way of an example of a treatment line, well designed to accomplish the purpose of the invention, modification whereof will be apparent to to those skilled in the art, what is claimed is:

1. A method for exposing to a treatment operation a single face of a metallic strip, said method comprising applying a first pair of ribbons of molten solder material one ribbon along each edge of a first metallic strip on one face thereof, allowing said first pair of ribbons of solder material to cool sufficiently to solidify, applying a second pair of ribbons of molten material one ribbon along each edge of a second metallic strip on one face thereof, allowing said second pair of ribbons of solder material to cool sufficiently to solidify, joining said first and second metallic strips back-to-back at the edges thereof by re-melting said ribbons of solder material and allowing said solder material to solidify, passing said joined metallic strips through a treatment station for treating the exposed faces of said joined strips, applying heat to said joined metallic strips proximate the edges thereof for melting said solder material, and peeling said metallic strips from each other.

2. The method of claim 1 further comprising unwinding said first and second metallic strips from separate coils prior to applying a pair of ribbons of solder material one ribbon along each edge of one face thereof, and winding said metallic strips in separate coils after peeling said metallic strips from each other.

3. The method of claim 1 further comprising disposing a pair of metallic edge insert strips between said metallic strips in engagement with said ribbons of solder material prior to re-melting said solder material, and separating said edge insert strips from said metallic strips while simultaneously peeling said metallic strips away from each other after applying heat for melting said solder material.

4. The method of claim 2 further comprising disposing a pair of metallic edge insert strips between said metallic strips in engagement with said ribbons of solder material prior to re-melting said solder material, and separating said edge insert strips from said metallic strips while simultaneously peeling said metalic strips away from each other after applying heat for melting said solder material.

5. The method of claim 2 further comprising unwinding said edge insert strips each from a coil prior to inserting between said metallic strips, and rewinding said insert strips in separate coils after separation from said metallic strips.

6. The method of claim 1 wherein said treatment operation comprises plating of the exposed faces of the joined metallic strips by hot dipping in a bath of molten metal or metal alloy.

7. The method of claim 2 wherein said treatment operation comprises plating of the exposed faces of the joined metallic strips by hot dipping in a bath of molten metal or metal alloy.

8. The method of claim 3 wherein said treatment operation comprises plating of the exposed faces of the joined metallic strips by hot dipping in a bath of molten metal or metal alloy.

9. The method of claim 4 wherein said treatment operation comprises plating of the exposed faces of the joined metallic strips by hot dipping in a bath of molten metal or metal alloy.

10. The method of claim 5 wherein said treatment operation comprises plating of the exposed faces of the joined metallic strips by hot dipping in a bath of molten metal or metal alloy.

11. The method of claim 1 wherein said metallic strips are of substantially equal width and are joined back-to-back with flush edges.

12. The method of claim 2 wherein said metallic strips are of substantially equal width and are joined back-to-back with flush edges.

13. The method of claim 3 wherein said metallic strips are of substantially equal width and are joined back-to-back with flush edges.

14. The method of claim 4 wherein said metallic strips are of substantially equal width and are joined back-to-back with flush edges.

15. The method of claim 5 wherein said metallic strips are of substantially equal width and are joined back-to-back with flush edges.

16. The method of claim 6 wherein said metallic strips are of substantially equal width and are joined back-to-back with flush edges.

17. The method of claim 7 wherein said metallic strips are of substantially equal width and are joined back-to-back with flush edges.

18. The method of claim 8 wherein said metallic strips are of substantially equal width and are joined back-to-back with flush edges.

19. The method of claim 9 wherein said metallic strips are of substantially equal width and are joined back-to-back with flush edges.

20. The method of claim 10 wherein said metallic strips are of substantially equal width and are joined back-to-back with flush edges.

21. The method of claim 1 wherein said metallic strips are of substantially equal width and are joined back-to-back with a predetermined offset.

22. The method of claim 2 wherein said metallic strips are of substantially equal width and are joined back-to-back with a predetermined offset.

23. The method of claim 3 wherein said metallic strips are of substantially equal width and are joined back-to-back with a predetermined offset.

24. The method of claim 4 wherein said metallic strips are of substantially equal width and are joined back-to-back with a predetermined offset.

25. The method of claim 5 wherein said metallic strips are of substantially equal width and are joined back-to-back with a predetermined offset.

26. The method of claim 6 wherein said metallic strips are of substantially equal width and are joined back-to-back with a predetermined offset.

27. The method of claim 7 wherein said metallic strips are of substantially equal width and are joined back-to-back with a predetermined offset.

28. The method of claim 8 wherein said metallic strips are of substantially equal width and are joined back-to-back with a predetermined offset.

29. The method of claim 9 wherein said metallic strips are of substantially equal width and are joined back-to-back with a predetermined offset.

30. The method of claim 10 wherein said metallic strips are of substantially equal width and are joined back-to-back with a predetermined offset.

31. The method of claim 1 wherein one of said metallic strips is narrower than the other and said metallic strips are joined back-to-back with at least one marginal area at an edge of the other of said metallic strips projecting beyond a corresponding edge of the narrower one of said metallic strips.

32. The method of claim 2 wherein one of said metallic strips is narrower than the other and said metallic strips are joined back-to-back with at least one marginal area at an edge of the other of said metallic strips projecting beyond a corresponding edge of the narrower one of said metallic strips.

33. The method of claim 3 wherein one of said metallic strips is narrower than the other and said metallic strips are joined back-to-back with at least one marginal area at an edge of the other of said metallic strips projecting beyond a corresponding edge of the narrower one of said metallic strips.

34. The method of claim 4 wherein one of said metallic strips is narrower than the other and said metallic strips are joined back-to-back with at least one marginal area at an edge of the other of said metallic strips projecting beyond a corresponding edge of the narrower one of said metallic strips.

35. The method of claim 5 wherein one of said metallic strips is narrower than the other and said metallic strips are joined back-to-back with at least one marginal area at an edge of the other of said metallic strips projecting beyond a corresponding edge of the narrower one of said metallic strips.

36. The method of claim 6 wherein one of said metallic strips is narrower than the other and said metallic strips are joined back-to-back with at least one marginal area at an edge of the other of said metallic strips projecting beyond a corresponding edge of the narrower one of said metallic strips.

37. The method of claim 7 wherein one of said metallic strips is narrower than the other and said metallic strips are joined back-to-back with at least one marginal area at an edge of the other of said metallic strips projecting beyond a corresponding edge of the narrower one of said metallic strips.

38. The method of claim 8 wherein one of said metallic strips is narrower than the other and said metallic strips are joined back-to-back with at least one marginal area at an edge of the other of said metallic strips projecting beyond a corresponding edge of the narrower one of said metallic strips.

39. The method of claim 9 wherein one of said metallic strips is narrower than the other and said metallic strips are joined back-to-back with at least one marginal area at an edge of the other of said metallic strips projecting beyond a corresponding edge of the narrower one of said metallic strips.

40. The method of claim 10 wherein one of said metallic strips is narrower than the other and said metallic strips are joined back-to-back with at least one marginal area at an edge of the other of said metallic strips projecting beyond a corresponding edge of the narrower one of said metallic strips.

* * * * *